United States Patent [19]

Jones et al.

[11] Patent Number: 4,536,028

[45] Date of Patent: Aug. 20, 1985

[54] FITTED SHEET FOR LOUNGE CHAIR

[76] Inventors: Mary A. Jones, P.O. Box 154; Donna L. Tucker, Rte. 2, both of Polkton, N.C. 28135

[21] Appl. No.: 488,993

[22] Filed: Apr. 27, 1983

[51] Int. Cl.[3] ..... A47C 27/00

[52] U.S. Cl. ..... 297/224; 297/229

[58] Field of Search ..... 297/229, 224, 219, 218; 5/499

[56] References Cited

U.S. PATENT DOCUMENTS 1,964,242 6/1934 Behrle ..... 297/223
2,696,872 12/1954 Kurland et al. ..... 5/499

FOREIGN PATENT DOCUMENTS 1511646 12/1967 France ..... 297/219
929027 6/1963 United Kingdom ..... 297/229

*Primary Examiner*—Kenneth Downey
*Attorney, Agent, or Firm*—Bell, Seltzer, Park & Gibson

[57] ABSTRACT

A fitted sheet particularly adapted for use with lounge chairs of the type commonly used at poolside or the beach comprises a top panel for residing over the upper surface of the chair, pocket formations at each end of the top panel for fitting over the ends of the chair and transverse elastic straps for placement behind the chair at the points where the head and foot portions of the chair are hingedly connected to the horizontal central section of the chair. Gathering of the material in the central portion of the sheet provides enhanced versatility and increased conformity of the sheet to the chair.

4 Claims, 7 Drawing Figures

FITTED SHEET FOR LOUNGE CHAIR

FIELD OF THE INVENTION

The present invention relates to fitted sheets and, more particularly, to fitted sheets adapted for use with lounge chairs of the type commonly used at poolside or the beach.

DESCRIPTION OF THE PRIOR ART

Various forms of fitted sheets for use with conventional bed mattresses, and specialty fitted sheets for use with sofa beds, hospital beds, or the like, are well known. Most sheets of this type incorporate pocket formations for conforming to the corners of the mattresses and, in some cases, a continuous perimetric underlay panel for residing under the edge of the mattress and in contact with the underlying mattress support.

No known sheet of the prior art is well suited for use with lounge chairs of the type used at poolside or the beach which include a horizontal central section and back-support and leg-support sections that are tiltable with respect to the central portion. Most often at the oceanside or poolside such chairs are seen covered with beach towels or blankets that have no attachment or securement to the chair. Such towels and blankets are subject to being blown away when the chair is not occupied. Furthermore, in use the towels and blankets tend to shift, thereby subjecting the user to uncomfortable direct exposure to the chair surface.

Accordingly, there is a need for a simply formed fitted sheet designed for use with beach-type lounge chairs to overcome the aforementioned disadvantages.

SUMMARY OF THE INVENTION

The present invention provides a novel fitted sheet that is particularly adapted for use with lounge chairs of the type commonly used at poolside or the beach. More particularly, in accordance with the present invention, a fitted sheet is provided with a substantially rectangular top panel of substantially the same size as the top surface of the lounge chair and with pocket formations at each end for fitting over the ends of the chair. The sheet also includes transverse elastic straps for fitting behind the chair at the points where the back and foot support sections of the chair are hingedly joined to the horizontal central portion of the chair.

In a particular embodiment of the invention, the central portion of the sheet that overlies the central horizontal section of the chair is gathered by elastic strip material provided at the sides of the sheet. This gathering renders the sheet more versatile in the range of chair sizes it may cover and also serves to assist in holding the center portion of the sheet in non-shifting engagement with the chair.

BRIEF DESCRIPTION OF THE DRAWINGS

The invention will be more fully understood from the following detailed description thereof taken in connection with the accompanying drawings, in which.

DETAILED DESCRIPTION OF INVENTION

While the present invention will be described hereinafter with particular reference to the accompanying drawings, it is to be understood at the outset of the description which follows that it is contemplated that persons skilled in the appropriate arts may vary the apparatus, methods and products used while still accomplishing the favorable results achieved by the present invention. Accordingly, the description is to be understood as a broad teaching disclosure directed to persons of appropriate skill in the appropriate arts, and not as limiting upon the scope of this invention.

Figure 1:
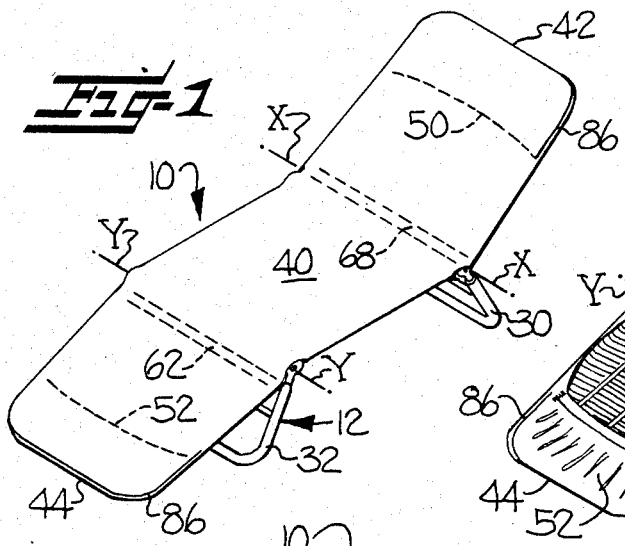
FIG. 1 is a perspective view of the cover as it is applied to a lounge chair with underlying parts of the cover shown in dotted lines.
Figure 2:
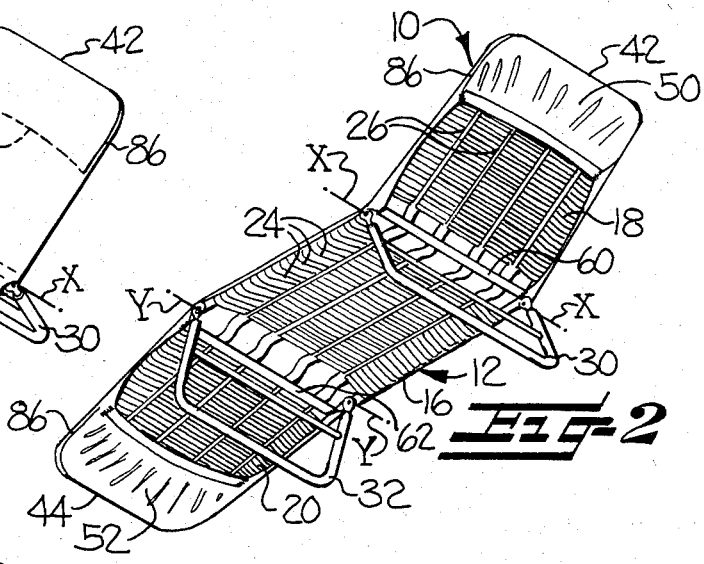
FIG. 2 is a perspective view looking up at the bottom of the lounge chair of FIG. 1 and showing the fastening means for securing the cover thereto.
Figure 3:
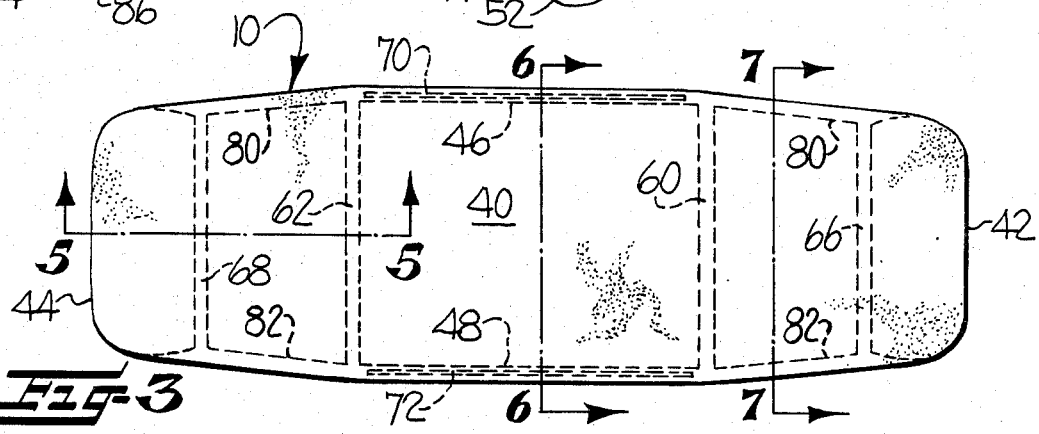
FIG. 3 is a plan view of the cover with underlying parts shown in dotted lines.
Figure 4:
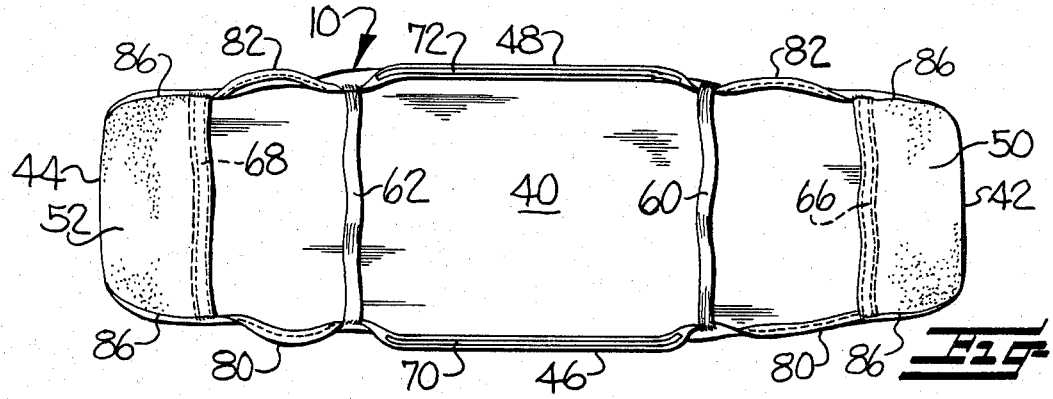
FIG. 4 is a bottom plan view of the cover in a relaxed position.
Figure 5:
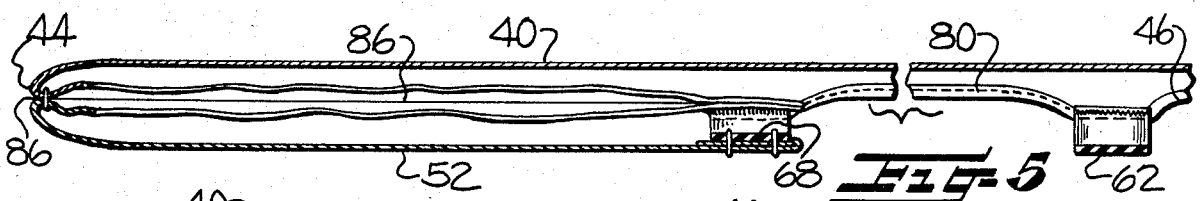
FIG. 5 is a longitudinal section view taken substantially along line 5—5 of FIG. 3.

Referring to the drawings, and particularly to FIGS. 1 and 2, there is shown a fitted sheet 10 of the invention in place over a conventional beach-type lounge chair 12.

Chair 12 is of the well known type having a substantially horizontal central section 16 and joined back-support and leg-support sections 18 and 20, respectively.

Sections 18 and 20 are capable of being vertically tilted with respect to central section 16 along transverse hinge lines X and Y to place chair 12 in the desired configuration for best supporting the user's back and legs. While various mechanisms are available for achieving the tilting of sections 18 and 20, a conventional ratchet mechanism (not shown) is most commonly used.

Referring to FIG. 2, the illustrated chair includes abutting transverse plastic strips 24 for supporting the user. The transverse strips are in turn supported in part by spaced longitudinal straps 26 in a manner well known to those skilled in the art. Appropriate legs 30, 32 are mounted to the chair adjacent hinge lines X, Y, for supporting the chair at poolside or in sand at the beach.

Fitted sheet 10 includes a top panel 40 whose perimeter defines a pair of opposed ends 42, 44 and a pair of opposed sides 46, 48. In the illustrated embodiment, top panel 40, while somewhat tapered toward the ends, is substantially rectangular and has a size and shape approximating the size and shape of the upper surface of lounge chair 12.

Sheet 10 includes pockets 50, 52 formed at the respective ends of top panel 40. Each pocket comprises a continuous panel joined to the respective end of the top panel and to adjacent portions of the sides. It has been found that a top panel adjoining the adjacent sides along a length of at least about six inches, providing a pocket depth of at least about six inches, is desirable. A pocket depth on the order of about ten inches is preferred.

Sheet 10 further includes a pair of transverse elastic straps 60, 62 joined to the opposed sides 46, 48. Strap 60 is located in the region where sheet 10, in use, overlies the hinge line X. Strap 62 is located in the region of hinge line Y. Thus, in the usual situation where sheet 10 is adapted for use with lounge chairs having sections 16, 18, 20 of substantially equal length, the transverse elastic straps 60, 62 are located approximately ⅓ the length of the sheet from each end 42, 44.

The provision of pockets 50, 52 and straps 60, 62 serves to hold the portions of sheet 10 overlying the back-support and leg-support sections 18, 20 in close and non-shifting relation to the top surface of chair 10. It will be appreciated that, as in the illustrated embodiment, elastic strips 66, 68 may be secured along the inwardly disposed edges of pockets 50, 52 in order to assist in holding the pocket firmly in place underlying the chair sections and to assist in preventing shifting of the sheet above sections 18, 20.

Since the portion of sheet 10 overlying central section 16 is somewhat more free to shift with respect to the chair, it has been found advantageous to secure longitudinal elastic strips 70, 72 along the sides 46, 48 in the region between hinge lines X and Y. These elastic strips in their relaxed state are preferably somewhat shorter than the distance between hinge lines X and Y so that in use the strips are stretched into tension and tend to hold the portion of sheet 10 overlying the chair's central panel in non-shifting relation to the panel. Preferably, the width of sheet 10 in the region overlying the chair's central section 16 is approximately the same width as the chair so as to cover substantially the entire chair surface while eliminating the need to tuck material under the chair.

While the type of chair illustrated in the drawings is the most common beach-type lounge chair currently in use, other chairs are available that do not provide for hinging of the leg-support section with respect to the central section. The sheet illustrated in FIGS. 1–7 may be used with such chairs. Also, fitted sheets of the invention may be provided for such chairs with transverse elastic means provided only at the hinge line between the back-support and central sections. In this case, the longitudinal elastic strips 70,72 may run from the central section and along the sides of the sheet to the area of pocket 52.

In certain preferred embodiments sheet 10 is formed from terry material, preferably stretch terry material. It has been found that excellent results are achieved by the use of conventional stretch terry material that is stretchable substantially more in one direction than the other, with the more stretchable direction being oriented transverse to the sheet.

Figure 6:
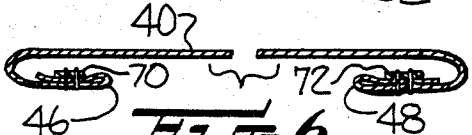
FIG. 6 is a transverse sectional view of the central portion of the cover taken substantially along line 6—6 of FIG. 3.
Figure 7:
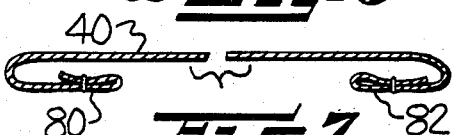
FIG. 7 is a transverse sectional view taken substantially along line 7—7 of FIG. 3.

A preferred method of forming sheet 10 will now be described with primary reference to FIGS. 3–7. The sides of top panel 40 are hemmed (as at 80, 82, FIG. 7) in the region between the pockets, with the lengths between straps 60,62 being gathered by incorporation of the mentioned elastic strips 70, 72 (FIG. 6). The panel material of pockets 50, 52 is secured to top panel 40 by conventional seams (as at seam 86, FIG. 5). The inwardly disposed edges of the pockets are hemmed and are gathered by the mentioned elastic strips 66, 68.

In a particular form of the illustrated embodiment, a versatile sheet was provided with a top panel having a length on the order of approximately 66 inches, a center width of approximately 20 inches and a somewhat reduced width at the ends of approximately 18 inches. As pointed out above, the material between straps 60, 62 is gathered by longitudinal elastic strips 70, 72. The gathering was at a ratio of approximately 5 inches of material to 4 inches of finished seam. Thus, while the length of gathered material between straps 60, 62 is approximately 24 inches, this portion of sheet 10 may be easily expanded to approximately 30 inches by stretching of elastic strips 70, 72. While a gathering ratio of approximately 5 to 4 has proven most satisfactory, the gathering ratio may suitably be in the range of about 3 to 2 through 8 to 7.

It will be appreciated that sheet 10 may be easily placed over a lounge chair by fitting the transverse straps 60, 62 over the ends of the chair and sliding them into position so as to reside at the chair's hinge lines X, Y, while positioning pockets 50, 52 to reside at each end of the chair, as best shown in FIG. 2. In combination with the mentioned longitudinal elastic strips 70, 72, the straps 60, 62 and pockets 50, 52 conformingly fit the sheet to the chair to prevent shifting of the sheet in use.

While the present invention has been described in connection with a specific embodiment, it will be appreciated that modifications may be made withou departing from the true spirit and scope of the invention.

What is claimed is:

1. A fitted sheet for covering a lounge chair of the type having a substantially horizontal central section and joined back-support and leg-support sections capable of being tilted with respect to the central section along transverse hinge lines, and said sheet being characterized by being constructed for preventing the sheet from shifting when the chair is occupied or when the back-support or leg-support sections are being adjusted, said sheet comprising:

a substantially rectangular top panel whose perimeter defines a pair of opposed ends and a pair of opposed sides and which has a size and shape approximating the size and shape of the upper surface of a lounge chair of the mentioned type;

a pocket at each end of said top panel, each pocket comprising a continuous panel joined to a respective end of the top panel and to adjacent portions at least along about six inches of the sides said pockets being sufficiently deep to maintain opposite end portions of said sheet in position on opposite ends of said lounge chair;

a pair of transverse elastic straps joined to the opposed sides and located approximately ⅓ the length of said sheet from each end thereof, one strap being located in the region where the sheet, in use, overlies the hinge line between the central section and back-support section, and the other being located in the region between the central section and the leg-support section, said transverse elastic straps serving to maintain the central portion of said sheet in position on said lounge chair; and longitudinal elastic strip means secured to said opposed sides in the region where the sheet, in use, overlies the chair's central section and maintains the central portion of said sheet in tensioned condition.

2. A fitted sheet as claimed in claim 1 wherein the sheet is formed from terry material.

3. A fitted sheet as claimed in claim 2 wherein the sheet is formed from stretch terry material.

4. A fitted sheet as claimed in claim 3 wherein the stretch terry material is stretchable substantially more in one direction than the other, with the more stretchable direction being oriented transverse to the sheet.

* * * * *